United States Patent [19]

Iwata et al.

[11] Patent Number: 4,911,291

[45] Date of Patent: Mar. 27, 1990

[54] PACKAGING SET FOR SOLID ARTICLES

[75] Inventors: Fumio Iwata, Toyonaka; Nobuo Nishio, Nara; Takuo Tsuchida, Takarazuka, all of Japan

[73] Assignee: Takeda Chemical Industries, Ltd., Osaka, Japan

[21] Appl. No.: 326,797

[22] Filed: Mar. 21, 1989

[30] Foreign Application Priority Data

Mar. 23, 1988 [JP] Japan ..... 63-38523[U]

[51] Int. Cl.[4] ..... B65D 69/00

[52] U.S. Cl. ..... 206/223; 53/492; 206/445; 206/461; 206/469; 206/526; 206/532; 206/535; 414/404

[58] Field of Search ..... 414/404, 405; 206/461, 206/462, 467, 469, 470, 471, 445, 526, 528, 532, 535, 536, 0.8–0.82, 531, 223; 53/492, 468

[56] References Cited

U.S. PATENT DOCUMENTS

| | | | |
|---|---|---|---|
| Re. 29,705 | 7/1978 | Compere | 206/496 X |
| 2,935,180 | 5/1960 | von Martens | 206/535 |
| 3,182,789 | 5/1965 | Sparkes | 206/536 |
| 3,472,368 | 10/1969 | Hellstrom | 206/469 |
| 3,476,239 | 11/1969 | Jacob | 206/461 |
| 4,176,751 | 12/1979 | Gillissie | 414/405 X |
| 4,371,080 | 2/1983 | Haines | 206/531 |
| 4,474,294 | 10/1984 | Koppelmans | 206/535 X |
| 4,706,815 | 11/1987 | Curtis et al. . | |

FOREIGN PATENT DOCUMENTS

| | | | |
|---|---|---|---|
| 331939 | 11/1919 | Fed. Rep. of Germany | 206/535 |
| 1586480 | 6/1970 | Fed. Rep. of Germany . | |
| 2923106 | 12/1980 | Fed. Rep. of Germany | 206/461 |
| 55-86757 | 6/1980 | Japan . | |
| 55-115579 | 8/1980 | Japan . | |

OTHER PUBLICATIONS

Packaging Reference Issue 1986, vol. 31, No. 4.

*Primary Examiner*—Bryon P. Gehman
*Attorney, Agent, or Firm*—Wenderoth, Lind & Ponack

[57] ABSTRACT

A packaging set for solid articles including a container for accommodating the solid articles therein, and a film cover made of breakable thin film fixedly secured on the opening edge of the container so as to hermetically seal the opening of the container, and a casing including a case having a mouth corresponding to and slightly smaller than that of the opening of the container, and lid lid detachably set onto the case so as to be able to move to close or open the mouth of the case. Side edges of the mouth of the case are applied to press onto the film of the cover of the receptacle to break the film at portions corresponding to at least three sides of the opening of the container. All the solid articles in the container are thus able to transfer into the case at one time, leaving the broken film behind with the container.

14 Claims, 5 Drawing Sheets

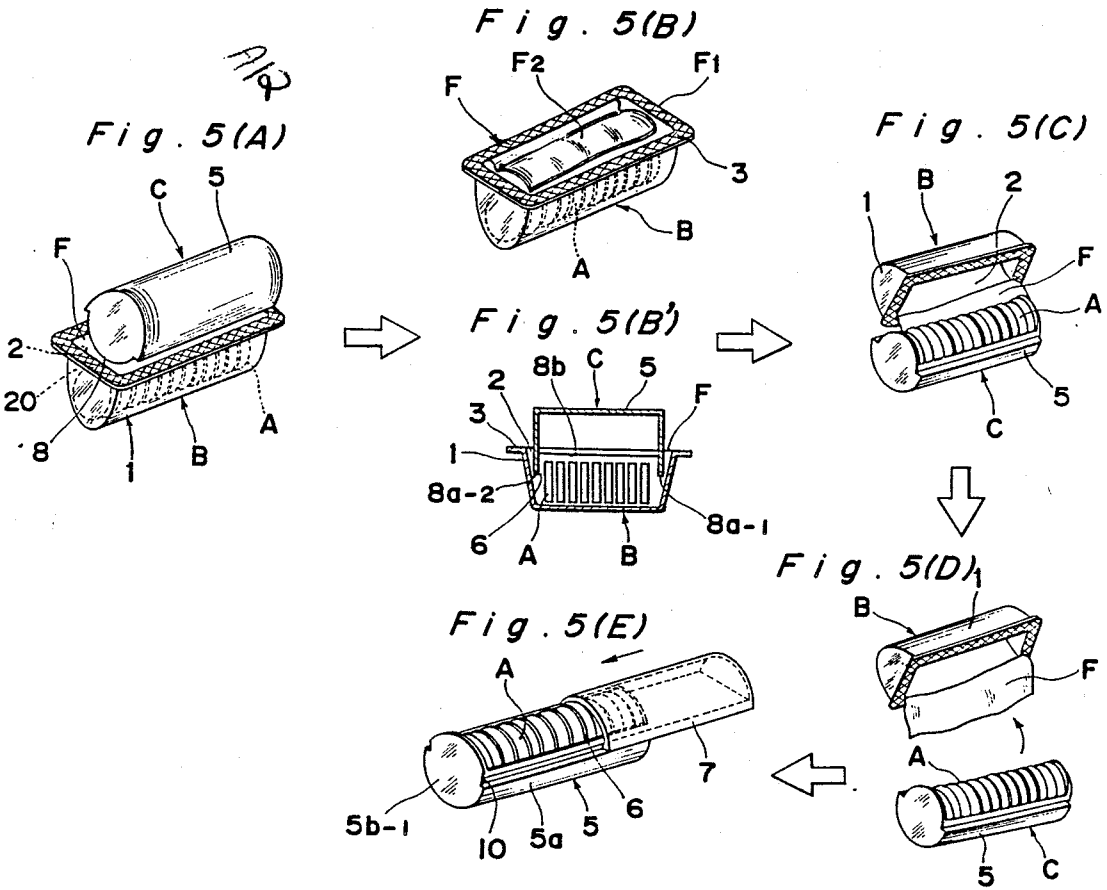
A/2

PACKAGING SET FOR SOLID ARTICLES

BACKGROUND OF THE INVENTION

The present invention generally relates to a packaging set for solid articles which includes a blister package for accommodating hermetically sealed solid articles such as medicines or drugs having the shape of tablets, pills, troches, capsulated materials or the like therein, and a carrier casing or tablet dispenser of 2 portable type for use in receiving the solid articles from the blister package therein, which allows the transfer operation for the solid articles to be easily carried out without causing any problems.

Generally, medical products or drugs are not only value-added expensive items, but are given a long term quality guarantee, and accordingly it is required for to prevent deterioration of quality of the products during the distribution or storage thereof. For this reason, a package container or receptacle for the medical products must function as a hermetic seal to protect the quality of the products. On the other hand, the packaging container is required to allow easy dispensing of the medical products when necessary. The above-mentioned two functions are contrary to each other, namely, the sealing function and easy dispensing function cannot be achieved by one packaging container alone from the practical view point because of restrictions in design and high manufacturing cost.

Accordingly, conventionally, a carrier dispenser is attached to an original container when solid medicines such as tablets, capsulated materials etc. which are relatively often carried outside among medical products are concerned. In this case, when the solid medicines are carried outside, the solids medicines should be repacked from the original container to the carrier dispenser, so that the solid medicines can be easily taken out when necessary. Therefore, a large plastic bottle or a large plastic box is employed for the original container for many cases. A additionally used as the carrier dispenser. Besides, the solid medicines are generally formed as dislike tablets and therefore are packed in compact within the carrier dispenser if they are piled up in a thickness direction.

In the conventional arrangement as described above, however, it is inconvenient to repack the solid medicines from the original container to the carrier dispenser.

For instance, the solid medicines are changed from the original container to the carrier dispenser generally in the following complicated procedure.

(1) In each of the original container and carrier dispenser a space for the changimg operation is necessary to provide of itself in addition to a capacity for the accommodation, respectively.

(2) A temporary container for temporarily containing tablets and a pincette for the changing operation are prepared separately from the original container.

(3) A mouth of the original container is opened.

(4) Tablets, the number of which is selected on the supposition that it approximately corresponds to the capacity of the carrier dispenser are changed from the original container into the temporary container.

(5) The tablets changed into the temporary container are changed to the carrier dispenser by the use of the pincette.

(6) The tablets are aligned in a row within the carrier dispenser.

(7) If the tablets in the temporary container are less or more than the capacity of the carrier dispenser, the corresponding amount of the tablets are additionally taken out from the original container or returned back to the original container.

(8) The case cover of the carrier dispenser is closed.

(9) The mouth of the original container is closed.

(10) The temporary container and the pincette are put away to the initial positions.

In addition, in a special case, the abovedescribed operations (5) and (6) may sometimes be necessary to be repeated. Also, if the tablets are changed and moved by fingers of an operator without use of the pincette, the fingers should be cleaned before and after the changing operation.

As described hereinabove, according to the conventional manner, many operations including the above ten steps are needed to be performed for changing tablets from the original container to the carrier dispenser. In addition, considerably attention should be taken so that the tablets do not scatter outside or do not get wet during the changing operation, and therefore the conventional changing operation is regared as troublesome or tiresome for an operator.

Moreover, in the changing operation, every time the mouth of the original container is opened, the interior of the original container is exposed to the air, which invites quality deterioration of the tablets contained in the original container as a result of moisture absorption or the like.

In order to eliminate the above-describe disadvantages, one solution can be proposed in such a manner that the original container is formed compact in size so as to be carried as is, whereby the changing operation can be omitted.

In general, the medical products are wrapped in a package mostly by a PTP (Press Through Pack) method by employment of a sealing film, for example, an aluminum foil, etc., to close the opening of the package air-tight. In the case of the PTP method, when solid medicines such as tablets or capsulated medicines are taken out of the package, the packed solid medicines are pressed from above by a finger or fingers of an operator thereby to break the sealing film of the package. Also, based on the above-described PTP method, a blister package which is used for packing various kinds of miscellaneous goods like a stick of rouge, a tube of adhesive agent, etc. can be employed to pack the solid medicines. For instance, as seen from FIGs. 11 and 12, a blister package B′ is constructed by sealing tablets A into a container 1′ by a film cover F′ bonded on the flange of an opening of the container 1′. When the tablets A are desired to be taken out from the package B′, the bottom of the container 1′ is pushed on by a finger or fingers of an operator to break the film cover F′ as shown in FIG. 11, or the film cover F′ is peeled off from the container 1 to open the opening of the container 1′ as shown in FIG. 12.

The above-described blister package is advantagous in that conventional manfacturing equipment can be used, a small amount of materials are enough for manufacture, and the form of the container is good for the carrying purpose. On the other hand, however, the blister package has been such drawbacks that once the film cover is broken or opened, the tablets remaining within the container exit at random from the opening of the container, while foreign items easily invade the package, deteriorating the quality of the tablets, causing poor appearance of the package and, subsequently the blister package is inconvenient in practical use.

SUMMARY OF THE INVENTION

Accordingly, an essential object of the present invention is to provide an improved package set for solid articles comprised of a blister package and a carrier casing which is designed to prevent the quality deterioration of solid articles, while maintaining a compact good-looking appearance during carrying and convenience of use, and to allow easy changing of all the solid articles from the blister package to the carrier casing at one time, or at a shot with breaking the film cover of container.

In accomplishing the above-described object, according to the present invention, a blister package for sealing the solid articles therein is accompanyed with a carrier casing for changing and storing the articles therein in the state for being able to remove the articles, therefrom, and the carrier casing is so constructed that, when a film cover of the blister package is pressed and broken by the carrier casing, all the articles contained in the blister package are changed into the carrier casing at one time.

More specifically, according to the first aspect of the present invention, the packaging set is a combination of a blister package including a container for accommodating a given amount of solid articles therein, and a film cover made of breakable thin film fixedly secured on a flange which is provided around the opening edge of the container, so as to hermetically seal the opening of the container, the opening having an approximately rectangular shape with four sides, and a carrier casing including a case having a mouth of rectangular shape corresponding to and slightly smaller than that of the opening of the container, and a lid detachably set onto the case so as to be able to cover to close or open the mouth of the case. At least one side edge of the mouth of the case is formed to be able to break the film of the cover by pressing onto the cover such, that when the side edges of the mouth of the case are applied to press onto the film to break portions of the film corresponding to at least three sides of the opening of the container, all the solid articles in the container are able to change into the case at one time while leaving the broken film behind with the container.

Namely, the packaging set is comprised of a long columnar blister package accommodating many solid tablets therein and a carrier casing having approximately the same size as the package for receiving the tablets from the package. The carrier casing has a case provided with a mouth open at one side of the case. The mouth of the case is covered by a lid in a manner to be freely openable or closable. The lid is slidable mounted on the case and is easily dissembled from the case to leave the case for the purpose of engaging with the package. A peripheral portion of the mouth of the case is so shaped as to be able to be fitted into an opening of the container. Solid articles in the package are taken out through the container opening. It is so arranged that the peripheral portion of the mouth of the case can break the film cover sealing the container along the inner periphery of a brimmed portion of the film cover facing the container opening.

According to a preferred embodiment of the present invention, the package set is partially modified as described hereinbelow.

To facilitate the solid articles, all of the solid articles formed of disk shape are piled up in succession in a direction along the center axes of the solid articles so as to form a single unit of approximate cylindrical shape within the package.

The container of the package is formed of approximately a lower portion of a half cylinder and an upper portion of a reversed cone frustum expanding outwardly from the upper sides of the lower portion to the opening of the upper portion, with a flange provided along the periphery of the opening of the upper portion and formed of a kind of brim having a shape of certain width in a rigid condition so as to facilitate recognition of the location of the opening of the container from the outside of the film cover.

For the purpose of engaging the case with the package, at least one of the sides of the mouth of the case is entended outwardly higher than the other sides of the mouth to contact the film of the cover more than the other sides which are lower to maintain the film unbroken, in such a manner that two short sides of the mouth of the case extend higher than the remaining two long sides of the mouth. One of the short sides of the mouth extends outwardly higher than the other of the short sides of the mouth, and one of the long sides of the mouth extends outwardly higher than the other if the long sides of the mouth, providing a sharp edge at the end of the one of the long sides of the mouth so as to facilitate abutment against the film of the cover at the side, while the film remains unbroken at the other side.

Also, the case is provided with a groove for engaging with the lid to slidably move the lid in the axial direction of the casing so as to open or close the mouth of the case, and a stopper in the groove to hold the lid at the position for opening the mouth of the case just enough to taking out the solid articles one by one therefrom.

The mouth of the case is formed to extend in a lengthwise direction of the case, and at the same time the lid is slidably fitted in a lengthwise direction in the case. In the package, in the film of the cover is made of aluminum film or a paper of glassine.

Accordingly, the present invention provides a packaging set for accommodating solid articles therein which is comprised of a blister package and a carrier casing, and all of the solid articles can be easily and readily changed from the blister package into the carrier casing in one successive step of the changing operation without exposing the solid articles to the air for long hours and to the fingers of a operation. Moreover, since a film cover which seals the blister package is arranged to be positively cut out when the solid articles are changed into the carrier casing, while some part of the film cover remains attached to the blister package, the changing operation is made much easier and less troublesome. Further, when the solid articles in the carrier casing are needed, they can be taken out one by one through slight sliding movement of the lid covering of the case.

BRIEF DESCRIPTION OF THE DRAWINGS

These and other objects and features of the present invention will become clear from the following description taken in conjunction with the preferred embodiments thereof with reference to the accompanying drawings, in which:

FIG. 1(A) is a perspective view, taken from below, of the package, FIG. 1(B) is a perspective view, taken from above, of the package, FIG. 1(C) is a side view, on an enlarged scale, of the package;

FIG. 3(A) is a front view of the case.

FIG. 4(A) is a cross-sectional view of the lid.

FIGS. 5(A) to (E) and (B'), are views explaining the operation of the invention. FIG. 5(A) is a perspective view of the blister package and case, FIG. 5(B) is a perspective view of the blister package, FIG. 5(B'), FIG. 5(C) and FIG. 5(D), respectively, are perspective views of the blister package and case, and FIG. 5 (E) is a perspective view of the carrier casing;

FIG. 5 is a perspective view of the carrier casing of FIG. 2;

FIG. 7(A) is a perspective view of the modification, FIG. 7(B) is a side view thereof, and FIG. 7(C) is a bottom view thereof;

FIGS. 8, 9 and 10 are showing respectively, perspective views, taken from below, of the blister packages; FIG. 11 is a cross-sectional view of the blister package, and FIG. 12 is a perspective view of the blister package.

DETAILED DESCRIPTION OF THE INVENTION

Figure 1A:
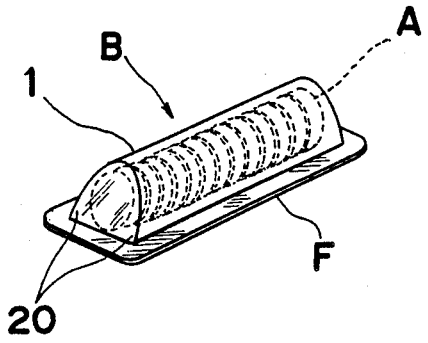
FIGs. 1(A) to (C), are views of a blister package in accordance with a preferred embodiment of the present invention.

Before the description of the present invention proceeds, it is to be noted that like parts are designated by like reference numerals throughout the accompanying drawings.

Figure 1B:
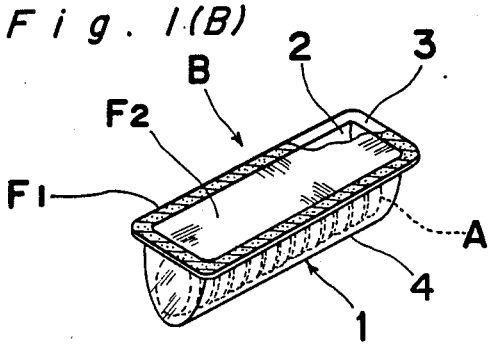
Figure 1C:
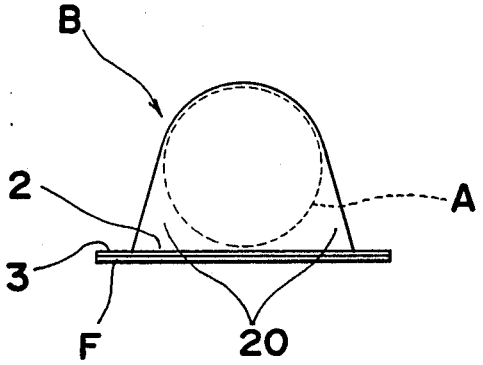
Figure 2:
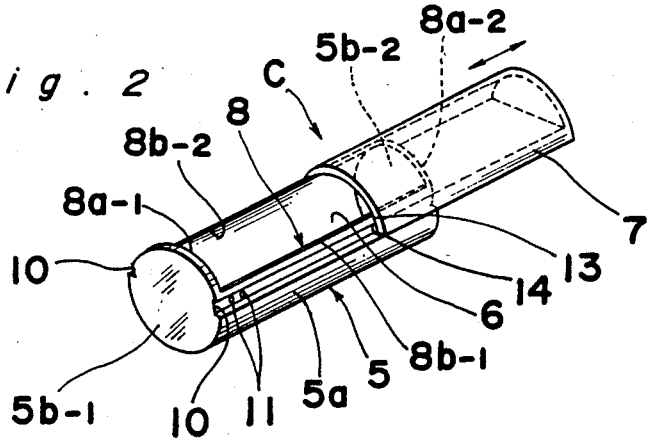
FIG. 2 is a perspective view of a carrier casing mating with the blister package of FIG. 1 in accordance with the preferred embodiment of the present invention.

Referring to FIGS. 1 and 2, in a preferred embodiment of the present invention, there is provided a packaging set for solid articles A comprising, in combination, a long-cylindrical blister package B for hermetically accommodating a given amount of tablets A therein, as shown in FIGS. 1 (A) to (C) and a carrier casing C of shape and dimension similar to the blister package for receiving therein all of the tablets A from the blister package B, as shown in FIG. 2. The blister package B is a container 1 made of 2 semi-rigid sheet for accommodating a given number of tablets A therein, and a film cover F made of breakable thin film and fixedly provided on the flange of an opening of the container 1 so as to hermetically close the opening of the container 1. The container 1 is a kind of receptacle having a shape suitable for receiving a unit of the tablets A each having the shape of disk and arranged in succession along the axial direction thereof. The carrier casing C is a case 5 having a mouth 6 open at one side of the case 5, and a case cover or lid 7 detachably and movably provided on the case 5 so as to freely open or close the case mouth 6. The peripheral side or sides 8 of the case mouth 6 are formed so as to be received into the container opening 2 through which the tablets A are removed to transfer into the case 5 through the case mouth 6. The film or film member of the cover F sealing the container opening 2 is able to be press-cut along inner periphery of a brimmed portion of the opening 2 by the peripheral edge of the side or sides 8 of the case mouth 6. The mouth 6 is open in a lengthwise direction, and the lid 7 is slidably fitted in a lengthwise direction of the case 5. At least one side edge of the case mouth 6 is formed to be able to break the film of the cover F by pressing onto the cover F.

In FIGS. 1(A) and (B), the tablets A accommodated in the blister package B are formed of a disk and stacked in the thickness direction within the long cylindrical container 1. All the tablets A are stacked in succession in a direction along the center axes of the tablets A so as to form a single unit of approximately columnar shape accommodated within the container 1. The blister package B has, as shown in FIG. 1(B), a rectangular opening 2 for removing the tablets A formed at the upper side of the container 1 and sealed with the film cover F. The container 1 is transparent and made by heat-molding a thermoplastic resin such as polyvinyl chloride, polypropylene, or the like. The container 1 is formed, as shown in FIG. 1(C), as approximately a lower portion of a half cylinder and an upper portion of a reversed cone frustum expanding outwardly from the upper sides of the lower portion to the opening of the upper portion. The flange 3 of the container 1 is formed of a kind of brim having a certain width in rigid condition so as to facilitate recoginition of the location of the film cover F from the outside. The film cover F is made of an aluminum, foil glassine paper, or the like subjected to a heat-seal coating, and the peripheral portion is heat-sealed to the upper surface of the flange 3 of the opening 2 after packing the tablets A in the container 1. As the container expands outwardly trooward the opening 2, there is some space 20 between the tablets and the inner surface of the container 1 upon sealing of the container 1 with the cover F. Also, for the purpose of facilitating the recognition of the location of the central portion of the film F closing the opening 2 and the peripheral portion of the film F bonded on the flange 3, there is provided a pattern of net shape on the flange 3, as shown in FIG. 1(B).

FIG. 3 shows the carrier casing C to be used when the tablets A contained in the blister package are transferred thereinto for carrying purpose. The carrier casing C is the case 5 and the lid 7, and is made of a plastic molded in a cylindrical shape having approximately the same length as the blister package, the case 5 and lid 7 being formed substantially a half cylindrical shape divided along the axial direction of the casing C. In other words, the upper half of the perpheral wall of the case 5 is removed, and the lid 7 is provided to cover approximately the same area as the removed portion of the peripheral wall 5*a* of the case 5. The tablets A are accommodated within the inner space of the casing C assembled with the case 5 and lid 7.

Figure 3A:
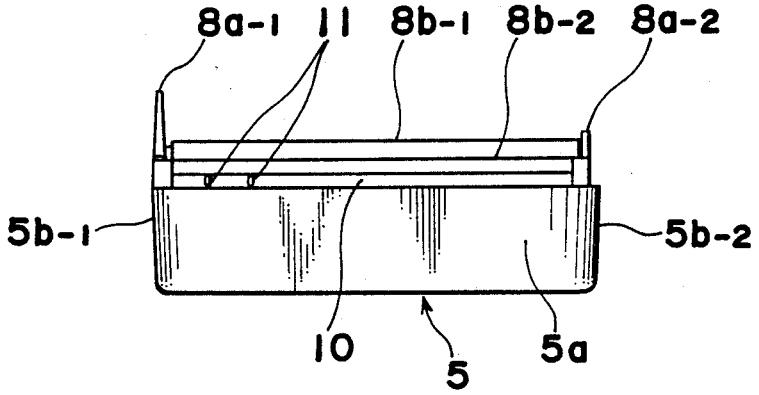
FIG. 3(A) and (B), are views, on an enlarged scale, of the carrier casing of FIG. 2.
Figure 3B:
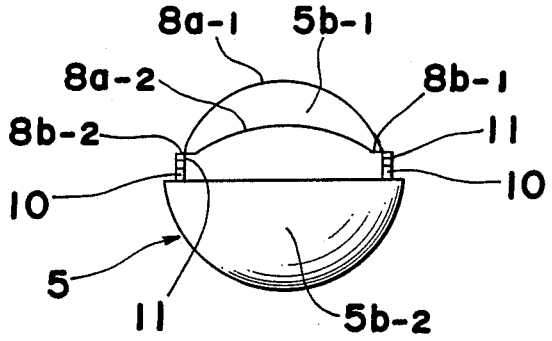
FIG. 3(B) is a side view of the case.
Figure 4A:
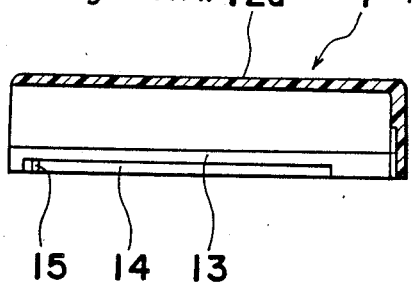
FIGS. 4(A) and (B), are views, on an enlarged scale, of a lid of the carrier casing of FIG. 2.
Figure 4B:
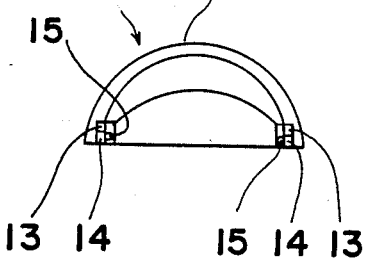
FIG. 4(B) is a side view of the lid.

In the state that the carrier casing C is turned sideways, the lid 7 freely, openably covers the mouth 6 formed at the upper side of a peripheral wall 5*a* of the case 5. The lid 7 is slidably engaged on the case 5 to move in the axial direction of the casing to open or close the mouth 6 of the case 5. The case 5 is provided with a pair of grooves 10 for engaging the lid 7 to slidably move the lid in the axial direction of the casing 5, and a pair of stoppers 11 in the groove 10 hold the lid 7 at the position for opening the mouth 6 just enough to dispense the tablets A one by one. More specifically, the container 1 has a shape of a half cylinder, as shown in FIGS. 3(A) and 3(B), providing a receptacle for accommodating the tablets A therein which is formed with a perpheral wall 5*a* of a half arc shape and a pair of side walls 5*b* and provides the mouth 6 of a rectangular shape surrounded by the four upper sides of the walls 5*a* and 5*b*. As the upper half of the peripheral wall of the case 5 is removed, and the lower half of the peripheral walls 5*a* and 5*b* are left as they are, the short sides 8*a* and 8*a* of the peripheral wall 5 are higher than the long sides 8*b* and 8*b*.

The four upper sides of the case mouth 6 is defined by two long sides 8*b*-1 and 8*b*-2 corresponding to the both upper ends of the peripheral wall 5*a*, and two short sides 8*a*-1 and 8*a*-2 corresponding to the upper ends of side walls 5*b* and is so designed that upper sides of the case mouth 6 are able to be inserted into the container opening 2 along the inner edge of the flange of the container 1. In the embodiment of FIGS. 3(A) and (B), each of the upper sides of the case mouth 6 is different in height with the sides so as to easily break the film F of the package B by the highest of the upper sides.

In other words, the two short sides 8*a*, 8*a* of the case mouth 6 extend higher than the remaining two long sides 8*b*, 8*b*. One of the short sides 8*a*, 8*a* of the mouth 6 is extended higher than the other of the short sides so that it will contact with the film of the cover before the other sides which are lower. The side wall 5*b* including the highest side 8*a*-1 has an oval shape constituting one side plane of the carrier casing C assembled with the lid 7 so as to be able to receive the tablets A. Each of the short sides 8*a*-1, 8*a*-2 of the mouth 6 is tapered from the stem to the end to form an edge suitable to thrust into the film F of the package B.

One of the long sides 8*b*, 8*b* of the mouth 6 is higher than the other of the long sides of the mouth 6, with a sharp edge at the end so as to facilitate to piercing the film at that side while the film F remains unbroken at the other side. Along the outer ends of the long sides 8*b*-1, 8*b*-2 are provided the pair of grooves into which the corresponding outer ends of the lid 7 are respectively slidably fitted to move the lid 7 in the axial direction of the casing to open or close the mouth 6 of the case 5. Within the grooves 10 are provided the pair of stoppers 11 at positions close to the highest of the short sides 8*a*-1 to tentatively hold the lid 7 at a position for opening the mouth 6 just enough to dispense one of the tablets A from the case 5.

The lid 7 is detachably, slidably mounted on the case 6 in engagement of the grooves 10 with corresponding grooves 13 provided on the inner ends of the lid 7, so that the lid 7 can be easily removed from the case 5 to open the mouth 6 fully to receive the tablets A from the package B into the case 5, and can be smoothly slid on the case 5 to close the mouth fully for carrying or partially for dispensing the tablets A from the case 5 with engagement of the stoppers 11 of the case with corresponding stoppers 15 provided in the grooves of the lid 7.

The rectangular upper sides 8 of the case mouth 6 are formed in a shape similar to and slightly smaller than the opening 2 of the blister package B. As shown in FIGS. 5(A) and 5(B'), when the short sides 8*a* of the case mouth 6 force through the film cover F to fit halfway into the blister package B, the long sides 8*b* touch the film cover F thereby to break the film cover F by pressing, as shown in FIG. 5(B).

In this embodiment, for enhancing the ability or efficiency of cutting the film cover F, it is effective to reduce the thickness of the upper sides 8 of the case mouth 6. Namely, in the case where the carrier casing C is contructed as in the present embodiment, since it is easy to make the thickness of the part of case 5 with the lid 7 small, it is advantageous from the view-point of enhancing the cutting efficiency.

As to the press-cut of the film cover F, it may happen that a cut-out part of the film cover F which is totally cut out along the overall periphery of the opening 2 of the package B accompanys the tablets A being transferred from the package B into the carrier casing C. However, although a film or a sheet is generally completely die-cut by a dyeing press in a conventional manner such film or sheet is provided with a pressure supporter provided at the reverse side of the film or the sheet. The film cover F of the embodiment of the present invention is never cut out completely along the whole periphery thereof, contrary to the case of conventional die-cutting, since between the tablets A and the film cover F there is formed a space 20 rendering a portion of the film F not pressed by the side of the mouth 6 of the case 5.

The results of experiments concretely showing the above-described fact will be described hereinbelow.

An aluminum foil or a glassine paper was employed for the film cover F. Moreover, the openings 2 of blister packages B were formed circular, triangular and square. The mouths 6 of carrier casing C were formed similar to the openings 2 of the blister packages B. When the edge of the mouth 6 of the case 5 was brought into contact with the film cover F of the blister package B, while applying force as uniformly as possible by fingers of an operator, it .was confirmed that the film cover F always started to be broken somewhere, but some part of the film cover F always remained unbroken. Particularly, in the case where the mouth 6 of the case 5 was triangular, square or rectangular, one side of the film cover F was not cut out, but remained attached to the blister package B. In addition, it is made clear that, so long as there is a space 20 between the film cover F and the tablets A accommodated in the package B, the film cover F is cut out by the case 5 in the above-mentioned manner even when the sides 8 of the mouth 6 are the same height along the whole periphery thereof . However, the film cover F can be more effectively cut out whwen the height differs along the periphery by inclinations or steps.

It is to be noted here that, according to the embodiment, the rectangular opening 2 and the rectangular mouth 6 are formed respectively at the upper sides of the container 1 of the blister package B and the upper sides of the peripheral wall 5*a* of the case 5, but, the opening 2 and mouth 6 may be formed in a circular shape at the lateral side of the container 1 and the case 5, respectively. In this case, the lid 7 is mounted in a screw-type construction or hinge-type construction instead of the slide type construction. Moreover, the carrier casing C may be formed in the shape of a pillar.

In the package set of the present invention having the above-described construction, solid medicines such as tablets A contained in the blister package B are transferred into the carrier casing C in the following steps, for instance, as shown in FIGS, 5(A) to (E) and (B').

(1) At a first step, the lid 7 is removed from the case 5 of the carrier casing C. Then, the sides of the mouth 6 of the case 5 are placed onto the film cover F of the blister package B, as shown in FIG. 5(A), to face against the opening 2 of the package B.

(2) Thereafter, at a second step as shown in FIG. 5(B'), the case 5 is pressed from above to break the film of the cover F along the brimmed portion of the opening 2 of the package B. At this time, since there is some room 20 in the inner space of the blister package B between the tablets A and the film of the cover F, one side of the four sides of the film cover F remains unbroken. In cutting the film cover F, when the case 5 is going to press onto the film cover F under keeping the case 5 in the almost horizontal position, the higest 8*a*-1 of the short sides of the case mouth 6 pierces into the film cover F to cut by the sharp edge one of the short sides of the container opening 2 sealed by the film cover F. Continuously, the other 8*a*-2 of the short sides of the case mouth 6 is going to cut the other of the short sides of the container 1, and then, the higher one 8*b*-1 of the long sides of the case mouth 6 is moved into contact with the film cover F to cut the corresponding one of the long sides of the container opening 2 while the other of the long sides of the container opening remains in the un-cut state, though the film cover F is bent downwardly into the container 1 by pressing by the other 8*b*-2 of the long sides of the case 5. Accordingly, the film cover F is cut at three sides 8*a*-1, 8*a*-2, 8*b*-1 thereof, but is not cut at the one side remaining within the container 1, as shown in FIG. 5(B).

(3) At a third step as shown in FIG. 5(C), under the condition as mentioned in the second step, by reversing the blister package B and the carrier casing C, the tablets A are transferred from the blister package B into the carrier casing C simultaneously through the container opening 2 and the case mouth 6 while the tablets A are kept aligned and in order. In this state, the film of the cover F is folded at the unbroken portion thereof and laid the tablets A under extending from the package B into the casing 5.

(4) Then, at a fourth step as shown in FIG. 5(D), when the blister package B is raised to seperate from the case 5, the film of the cover F can be slipped out from under the tablets A, and the blister package B together with the film cover F is separated from the carrier casing C. The empty blister package receptacle B is disposed of properly.

(5) Finally, as a fifth step as shown in FIG. 5(E), the lid 7 is assembled with the case 5 by enaging the grooves 13 of the lid 7 with the corresponding grooves 10 of the case 5 to cover the case mouth 6 by the lid 7. The lid 7 is sildably mounted on the case 5 to close the case mouth 6 completely, or partially by engaging between the stoppers 11, 15 of the case 5 and lid 7.

Figure 6:
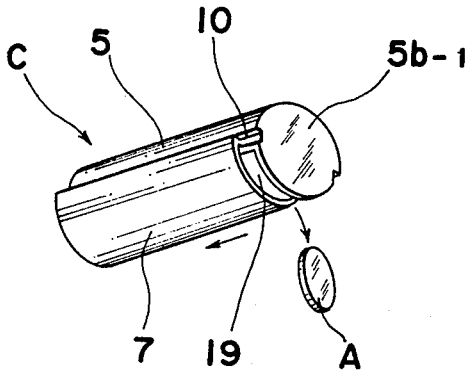

With the above steps, it is easy for an operator to transfer the tablets A from the blister package B to the carrier casing C all at one time by removing the lid 7 from the case 5, pressing the case mouth 6 onto the container opening 2 to break the film cover F, transferring the tablets A from the container 1 to the case 5 through the container opening 2 and the case mouth 6, and reassembling the lid 7 onto the case 5. The tablets A accommodated within the case 5 can be easily taken out upon the partial opening of the mouth 6 by sliding the lid 7 to the position of the stoppers 11, 15, as shown in FIG. 6.

In the above-described manner, the transferring operation which has been divided into 10 steps according to the conventional method as described earlier can be completed by a reduced number of proceedings, such as five in one successive flow, and accordingly the transfer operation for the tablets can be made easy.

Moreover, since not only the blister package B which is the original container of the tablets A has a high sealing efficiency and protective function during the storage of the tablets A, but the changing operation can be carried out with ease without exposing the tablets A to the air for a long time, and without touching the tablets by fingers of an operator directly, the packaging set of the present invention can avoid quality deterioration of the tablets. Also, in the construction of the packaging set, since the short sides of the film cover F are positively press-cut by the short sides 8*a* and 8*a* of the peripheral walls 8 of the case mouth 6, as shown in FIGS. 5(A) to (E) and (B'), the film cover F can be readily slipped out from under the tablets A, thereby rendering much easier the changing operation of the tablets A. Additionally, the tablets A can be taken out from the carrier casing C one by one by sliding the lid 7 in a lengthwise direction to open the mouth 6 of the case 5 partially, are therefore the carrier casing C is convenient in use.

Therefore, in the embodiment of the present invention, the packaging set has many advantages such that the tablets can be transferred by a reduced number of operations in a successive flow, thereby realizing easy and ready changing of tablets from the blister package to the carrier casing.

Moreover, the original container of the tablets, namely, the blister package can tightly seal the tablets, and protect the quality of the tablets perfectly during the storage. Further, since the changing of the tablets from the blister package to the carrier casing can be easily carried out, in other words, the tablets can be less expose to the air and never touched by fingers directly, the tablets do not deteriorate in quality. Also, when taking out the tablets from the carrier casing, the tablets can be taken out one by one by sliding the lid in the lengthwise direction of the case and slightly opening the mouth of the case, resulting in improvement of the using convenience. In addition, since the film cover of the blister package receptacle can be positively cut out simultaneously at the opposite short sides thereof by the short peripheral walls of the mouth of the case, the film cover can be slipped out by a small movement to be removed from under the tablets, thus realizing an easier changing operation.

Figure 7A:
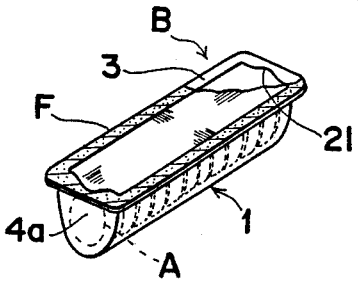
FIGs. 7(A) to (C) are views showing a modification of the blister package according to the present invention.
Figure 7B:
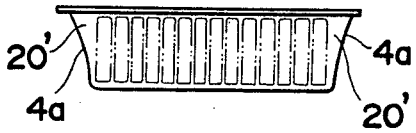
Figure 7C:
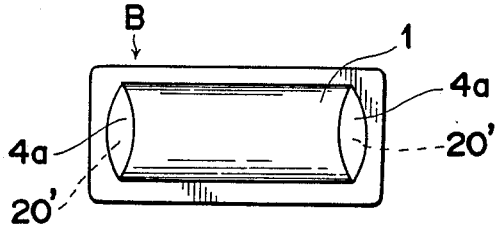
Figure 8:
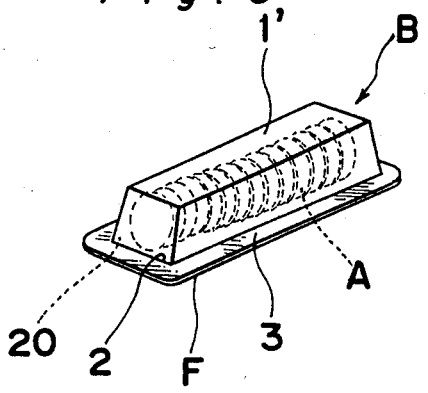
FIGS. 8 to 10 are views showing other modifications of the blister packages according to the present invention
Figure 9:
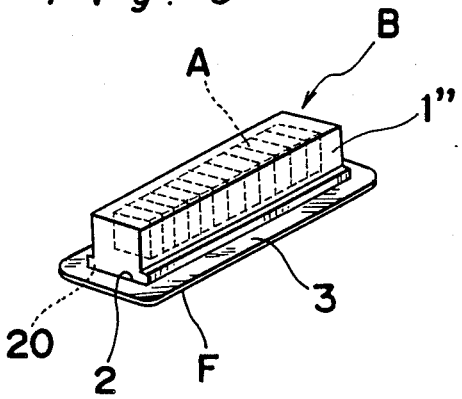
Figure 10:
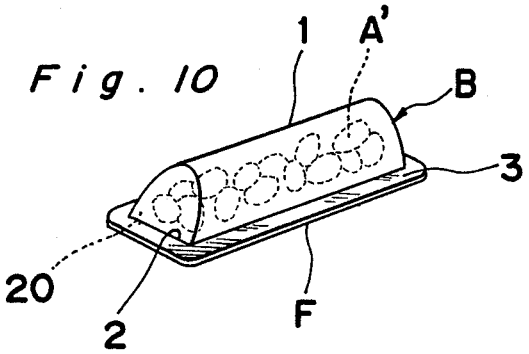
Figure 11:
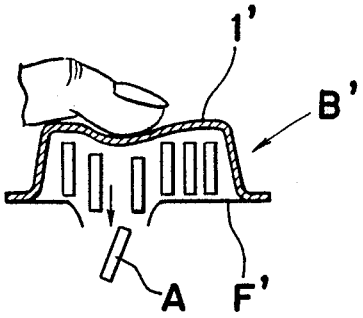
Fig. 11 PRIOR ART
FIGS. 11 and 12 are views of conventional blister packages.
Figure 12:
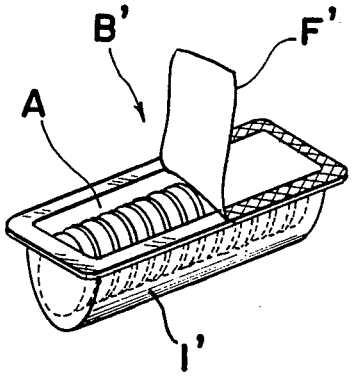
Fig. 12 PRIOR ART

Although the present invention has been fully described in connection with the preferred embodiments thereof with reference to the accompanying drawings, it is to be noted that various changes and modifications are apparent to those skilled in the art. For instance, FIGS. 7(A) to 7(C) show a modification of the blister package B of the present invention, wherein a pair of notches 21, 21 each having almost arc shape are provided in the inner edge of the short sides of the container flange 3, with corresponding portions of the container 1 close to the notches 21, 21 expanding outwardly in the axial direction of the package B, thereby to provide gaps 20', 20'between the notches 21, 21 and thew expanded portions in association with the space 20 between the film cover F and the tablets A accommodated in the container 1. With this modification, the amount of space is increased by the gaps 20', with an effect that the short sides of the film cover F is more easily cut out by the sides of the case 5. FIGS. 8 and 9 respectively show the other modification of the container 1 of the present invention, wherein the receptacle portion of container 1'or 1''to accommodate the tablets A is formed of a reversed cone frustum expanding outwardly from the bottom of the flange 3 as shown in FIG. 8, or is formed of a rectangular solid extending parallel from the bottom of the flange 3 as shown in FIG. 9. FIG. 10 shows a modification of the tablets A to be accommodated within the blister package of the present invention, wherein the tablets A'have a shape of round tablets smaller in size in comparison with the height of the container 1, thereby to provided a large space 20 between the film cover F and the tablets A'. Such changes and modifications are to be understood as included whihin the scope of the present invention as defined by the appended claims unless they depart therefrom.

What is claimed:

1. A packaging set for solid articles, comprising, in combination:

a package including a container for accommodating solid articles therein and having an opening, a flange extending from the periphery of said opening, and a film cover secured to said flange and thereby sealing said opening; and a casing including a case for accommodating the solid articles therein and having a mouth, said mouth having a shape corresponding to, and slightly smaller than, said opening, said mouth having means for piercing said film cover;

whereby when said mouth of said casing is aligned with said opening and pressed against said film cover, said means for piercing will pierce said film cover corresponding to said shape of said mouth about a portion of the periphery of said opening of said package, thereby allowing the solid articles to be transferred directly from said package to said casing while said film cover remains secured to said container.

2. A set as in claim 1 wherein said film cover hermetically seals said opening.

3. A set as in claim 2 , wherein said film cover includes aluminum film.

4. A set as in claim 2, wherein said film cover includes glassine paper.

5. A set as in claim 1, wherein said flange has a substantially uniform width about the periphery of said opening, whereby alignment of said mouth with said opening will be facilitated.

6. A set as in claim 1, further comprising a lid removably mounted on said case, said lid covering said mouth.

7. A set as in claim 1, wherein said mouth has a plurality of said edges, at least one of said side edges of said mouth extends outwardly from said case a distance greater than that of the remaining said side edges, and said side edges constitute said means for piercing said film cover.

8. A set as in claim 1, wherein said opening of said package and said mouth of said casing are both substantially rectangular, thereby defining four side edges of said mouth.

9. A set as in claim 8, wherein said four side edges of said mouth comprise a first pair of spaced substantially parallel sides edges and a second pair of spaced substantially parallel sides edges, said first and said second pair of side edges being substantially perpendicular, said first pair of side edges extends outwardly from said case a distance greater than that of said second pair of side edges, and said side edges constitute said means for piercing said film cover.

10. A set as in claim 9, wherein one of said first pair of side edges extends outwardly from said case a distance greater than that of the other of said first pair of side edges.

11. A set as in claim 10., wherein one of said second pair of side edges extend outwardly from said case a distance greater than that of the other of said second pair of side edges.

12. A set as in claim 1, further comprising a lid slideably removably mounted on said case, said lid covering said mouth.

13. A set as in claim 12, wherein said case includes at least one groove and said lid includes at least one projection slideably received in an associated said at least one groove to thereby slideably removably mount said lid.

14. A set as in claim 13, further comprising means for retaining said lid at a partially removed position, whereby said mouth of said casing is partially uncovered.

* * * * *